United States Patent [19]

Muragishi et al.

[11] Patent Number: 5,003,219

[45] Date of Patent: Mar. 26, 1991

[54] FIXED CONSTRUCTION FOR PLATE ELECTRODES IN A FLAT DISPLAY UNIT

[75] Inventors: Isao Muragishi, Osaka; Takashi Suzuki, Toyonaka; Takashi Kanehisa, Osaka; Makoto Inada, Nara, all of Japan

[73] Assignee: Matsushita Electric Industrial Co., Ltd., Osaka, Japan

[21] Appl. No.: 433,494

[22] Filed: Nov. 8, 1989

[30] Foreign Application Priority Data

Nov. 10, 1988 [JP] Japan ..... 63-284523
Nov. 10, 1988 [JP] Japan ..... 63-284524

[51] Int. Cl.[5] ..... H01J 29/46; H01J 29/82; H01J 1/88

[52] U.S. Cl. ..... 313/456; 313/422; 313/256

[58] Field of Search ..... 313/422, 438, 456, 482, 313/497, 444, 243, 245, 252, 256, 292; 445/29, 33, 67

[56] References Cited

U.S. PATENT DOCUMENTS 4,117,368 9/1978 Marlowe et al. ..... 313/422
4,853,586 8/1989 Peters ..... 313/256 X

*Primary Examiner*—Sandra L. O'Shea
*Attorney, Agent, or Firm*—Panitch, Schwarze, Jacobs & Nadel

[57] ABSTRACT

A fixed construction for plate electrodes in a flat display unit, wherein holes provided along a common axis through a plurality of plate electrodes have a diameter smaller than that of a tapered insulating pin to be inserted therein, and the peripheral portions of the holes are formed in a thin or tapered construction, thereby supporting and fixing the plate electrodes in position without interposing a spacer and without causing deformation to the areas around the peripheries of the holes formed in the plate electrodes when insulating pins are fitted.

4 Claims, 6 Drawing Sheets

FIXED CONSTRUCTION FOR PLATE ELECTRODES IN A FLAT DISPLAY UNIT

BACKGROUND OF THE INVENTION

1. Field of the Invention

The present invention relates to a fixed construction for plate electrodes in a flat display unit for an image producing apparatus.

2. Description of the Prior Art

In recent years, flat display units for displaying a colored television image have come into the spotlight. As illustrated in FIG. 12, the flat display unit displays a colored television image by focusing and deflecting electron beams emitted from electron beam sources 1 in both the horizontal and vertical directions using a plurality of plate electrodes 3, the electron beams landing on phosphors coated on each cell 4 of a screen 5.

In such flat display units, as shown in FIG. 13, a spacer c the insulating surfaces of which are coated with bonding glass b having a low melting point has previously been used, which is disposed between the above mentioned plate electrodes a to fix them accurately in position with a specified spacing provided therebetween and in an insulating manner from each other, the spacer c being heated, under pressure, up to the melting point (usually, approximately 500° C.) of the glass b to fix the plate electrodes a in position with the spacer c interposed therebetween. However, this conventional technique has had the problem that the heat causes oxidation and thermal deformation of the plate electrodes a, resulting in misalignment of landing areas of the electron beams, so that the picture quality will be substantially degraded.

To overcome the above problem with the prior art, the inventors of the present invention have proposed in their previous application a technique in which tapered insulating pins are press-fitted into holes formed in the plate electrodes which are disposed with a specified spacing provided therebetween, thereby supporting and fixing the plate electrodes in position with the specified spacing provided therebetween without interposing the spacer c (FIG. 13) as required in the prior art and without requiring heating.

However, the above-proposed previous technique has had the shortcoming that since the areas around the peripheries of the holes of the plate electrodes become deformed when the insulating pins are press fitted into the holes, the dimensional accuracy provided between the plate electrodes tends to deteriorate, resulting in misalignment of the landing areas of the electron beams and hence, degradation of the picture quality.

The previously proposed technique has had the further shortcoming that since sliding friction is caused between the insulating pins and the peripheral portions of the holes of the plate electrodes when press-fitting the insulating pins, metal powder shaved off the peripheral portions tends to adhere to the surface of the insulating pins, thus leading to shorting between the plate electrodes, and also the supporting strength of the insulating pins tends to be deteriorated because of flaws caused to the surface thereof, resulting in the deterioration of the pressure-withstanding strength of the plate electrodes.

SUMMARY OF THE INVENTION

A first object of the present invention is to provide a fixed construction for plate electrodes in a flat display unit, which is capable of supporting and fixing the plate electrodes in position without interposing a spacer and without causing deformation to the areas around the peripheries of the holes formed in the plate electrodes when insulating pins are fitted.

A second object of the present invention is to provide a fixed construction for plate electrodes in a flat display unit, which prevents the shaving off metal powder of the peripheral portions of the holes formed in the plate electrodes, as well as the flawing of the insulating pins, when the insulating pins are inserted.

To accomplish the first object, the present invention provides a construction in which holes provided along a common axis through a plurality of plate electrodes have a diameter smaller than that of a tapered insulating pin to be inserted therein, and the peripheral portions of the holes are formed in a thin or tapered construction.

To accomplish the first and second objects, the present invention provides a construction in which a plurality of plate electrodes are supported and fixed in position by inserting into holes formed along a common axis therethrough an insulating pin which is formed by a shape memory alloy having a C-shaped cross section whose outer diameter is slightly smaller before insertion than that of the holes but slightly expands at a prescribed temperature after insertion and whose outer circumferential surface is covered with an insulating material, the insulating pin being made to slightly expand in diameter at the prescribed temperature after insertion so as to support and fix the plate electrodes in position.

Furthermore, the present invention provides a construction in which the holes formed along a common axis through a plurality of plate electrodes are provided with a plurality of projections protruding inwardly of the peripheral portions thereof, the plate electrodes being supported and fixed in position by inserting a tapered insulating pin into the holes with the projections thereof pressing the outer circumferential surface of the insulating pin.

The present invention also provides a construction in which the projections provided on the holes formed along the common axis are offset from each other in the circumferential direction of the holes between the adjacent plate electrodes.

According to the present invention, since the holes of the plate electrodes have a smaller diameter than that of the insulating pin, the peripheral portions of the holes deform so as to press-contact the insulating pin inserted therein, thereby supporting and fixing the plate electrodes in position with the insulating pin. The peripheral portions have a smaller thickness than the surrounding areas so as to deform easily, therefore, only the peripheral portions are subjected to deformation, which prevents the deformation from expanding to the surrounding areas.

Also, the construction of the present invention is capable of supporting and fixing the plate electrodes in position with a specified spacing provided therebetween, without interposing a spacer, by press-fitting the tapered insulating pin into the holes of the plate electrodes disposed with the specified spacing provided therebetween.

Furthermore, according to the present invention, since the diameter of the insulating pin before insertion into the holes of the plate electrodes is smaller than that of the holes of the plate electrodes, no sliding friction is caused between the insulating pin and the peripheral portions of the holes, which prevents metal powder from being shaved off the peripheral portions and flaws from being caused to the surface of the insulating pin. The insulating pin inserted in the holes of the plate electrodes slightly expands in diameter at a prescribed temperature to cause the outer circumferential surface thereof to press-contact the peripheral portions of the holes, thereby providing a firm support to the plate electrodes. At this time, only a small amount of radially outwardly pressing force acts on the peripheral portions, and no deformation is caused in the inserting direction of the insulating pin. Accordingly, at least the areas surrounding the peripheral portions are prevented from being deformed.

Also, according to the present invention, since projections formed on the holes of the plate electrodes press-contact the outer circumferential surface of the insulating pin inserted therein, the insulating pin not being pressed into contact with the peripheral of the holes, the peripheral portions are prevented from being deformed, and the plate electrodes are supported and fixed in position by the insulating pin with the projections interposed therebetween.

Moreover, according to the present invention, when the insulating pin is inserted into the holes of the plate electrodes, there arises a possibility of metal powder being shaved off the edges of the projections, which adheres to the surface of the insulating pin in the form of streaks extending in the inserting direction, the projections formed on the hole of the adjacent plate electrode contacting the metal powder to cause shorting between the two plate electrodes, but since the projections formed on the holes are positioned in such a way as to be offset from each other in the circumferential direction between the adjacent plate electrodes, the metal powder shaved off the projections of one plate electrode and made to adhere to the insulating pin is prevented from contacting the projections of the other plate electrode, thus preventing the dielectric strength provided between the plate electrodes from dropping due to the metal powder adhering to the surface of the insulating pin.

Also, the construction of the present invention is capable of supporting and fixing the plate electrodes in position with a specified spacing provided therebetween, without interposing a spacer and without applying heat, by press-fitting the tapered insulating pin into the holes of the plate electrodes disposed with the specified spacing provided therebetween.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Example 1

FIGS. 1 to 5 show a first embodiment of the present invention.

Figure 12:
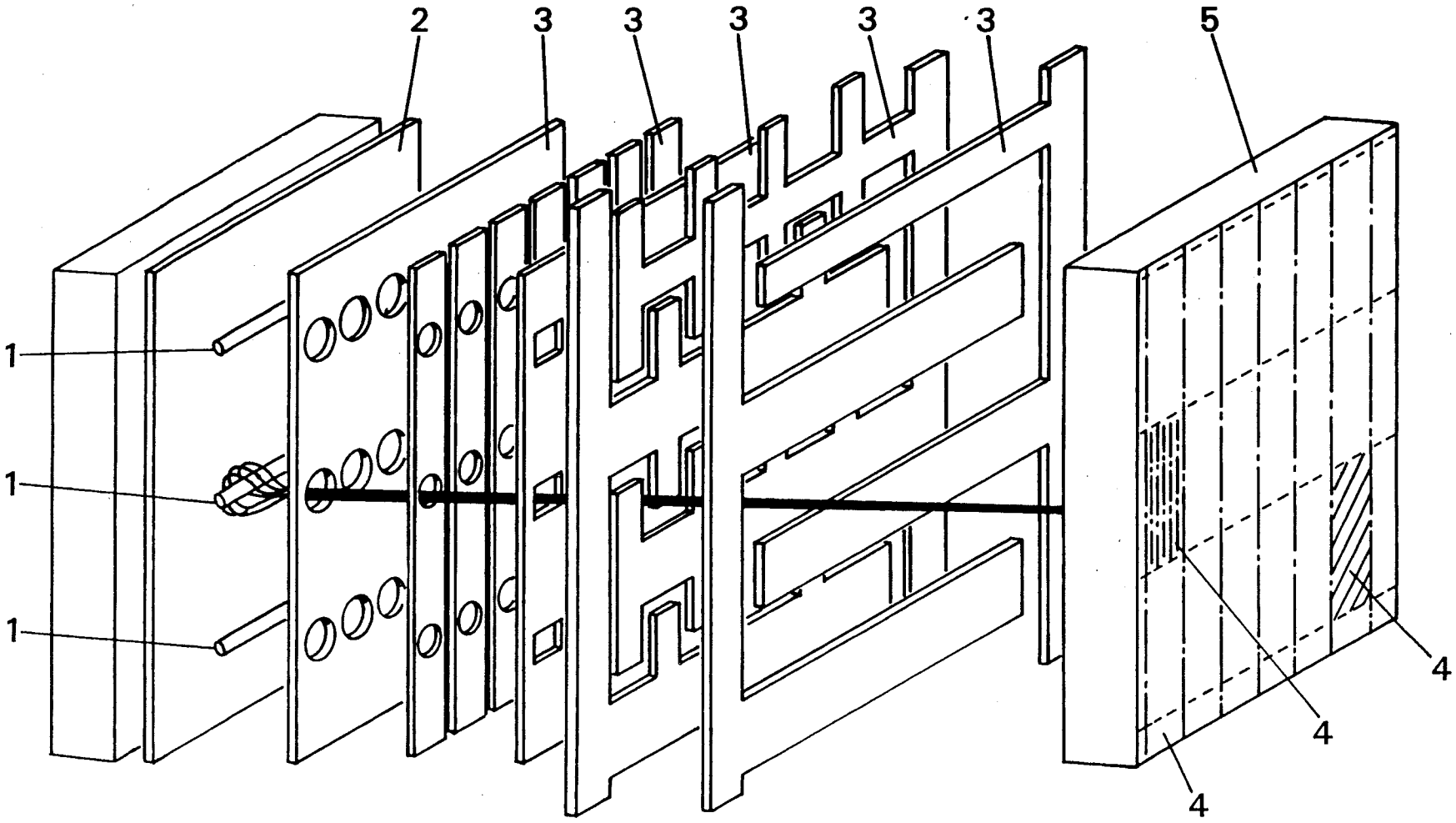
FIG. 12 is a perspective view showing a decomposed flat display unit.
Figure 13:
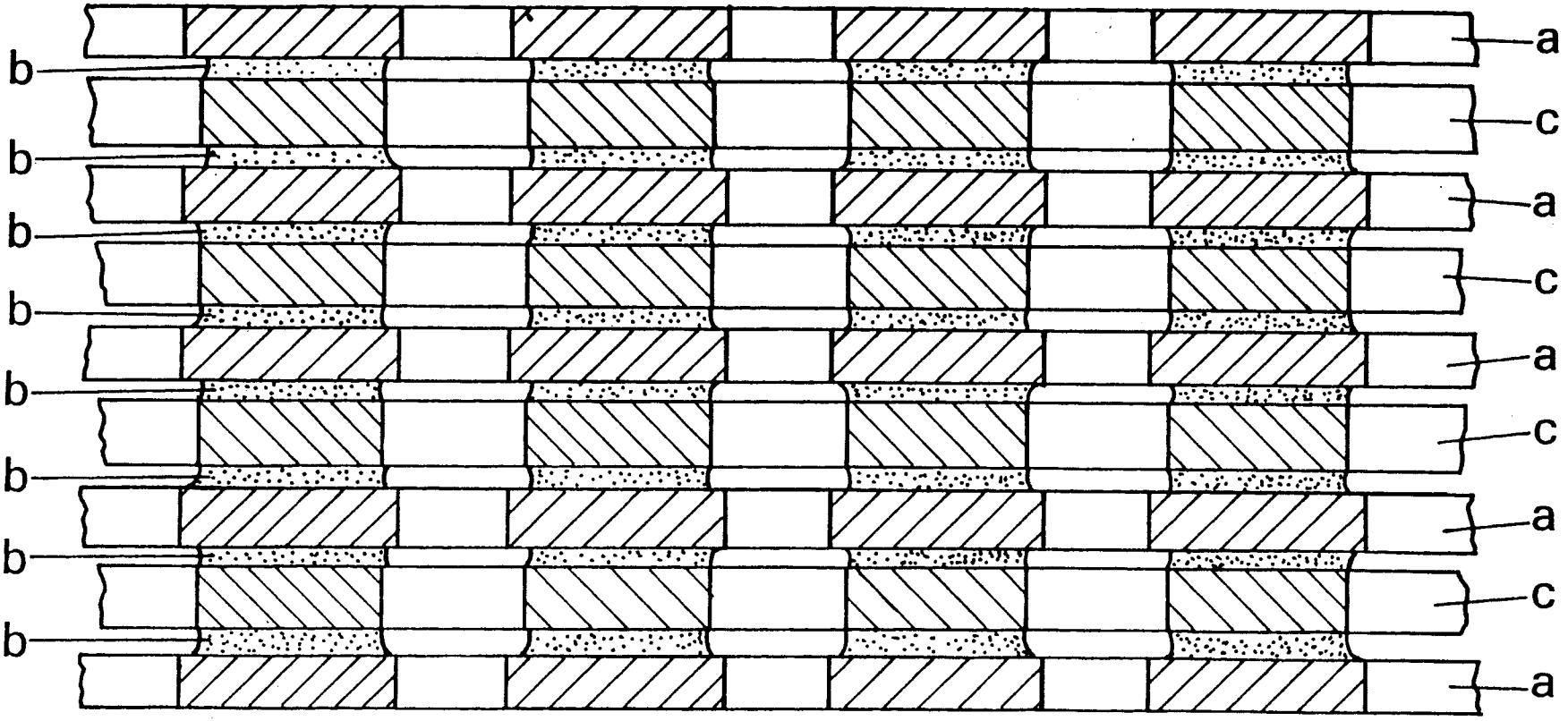
FIG. 13 is a cross sectional view showing a portion of a conventional fixed construction for plate electrodes.

The flat display unit of this embodiment comprises, as shown in FIG. 12, line cathodes 1 which act as the electron beam sources, a back plate 2 disposed therebehind, plate electrodes 3 disposed in front of the line cathodes 1 for controlling the electron beams emitted therefrom, and a screen 5 having cells 4 arrayed in both the horizontal and vertical directions thereon, each cell being coated with phosphors that respectively emit red, green, and blue colored lights when hit by corresponding electron beams. The whole construction is contained in a vacuum glass container not shown. The plate electrodes 3 comprise a beam drawing electrode, a signal electrode, a focusing electrode, a horizontal deflection electrode and a vertical deflection electrode.

Figure 1:
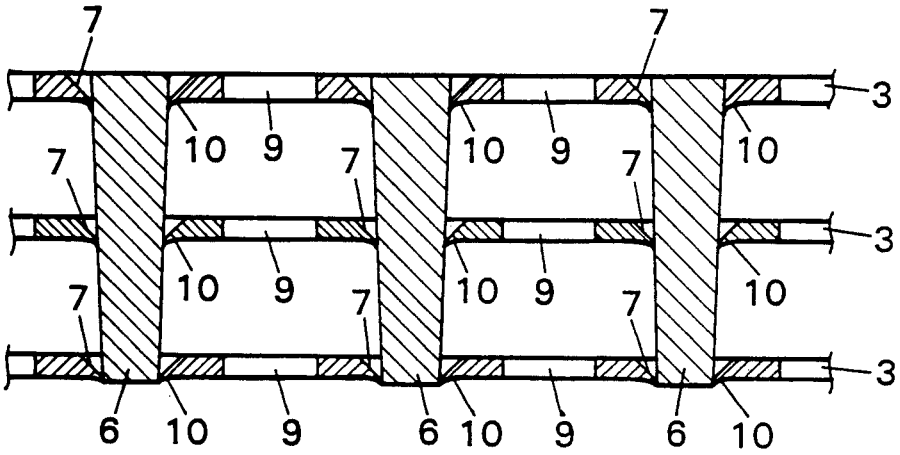
FIG. 1 is a cross sectional view showing a portion of a fixed construction for plate electrodes according to a first embodiment of the present invention.

In this embodiment, as shown in FIG. 1, a construction is described in which the plate electrodes 3, i.e. focusing electrode, horizontal deflection electrode, and vertical deflection electrode, are supported and fixed in position with tapered ceramic insulating pins 6 which are press-fitted into holes 7 formed in the plate electrodes 3.

Figure 2:
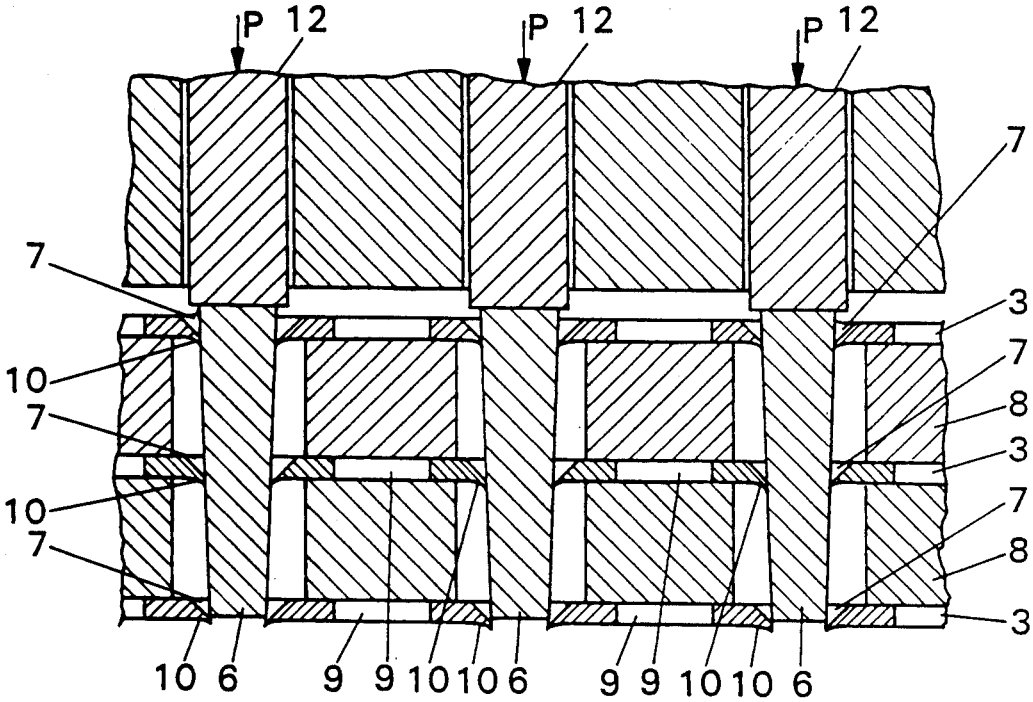
FIG. 2 is a cross sectional view showing a portion of the construction with insulating pins inserted into holes of the plate electrodes of FIG. 1.
Figure 3:
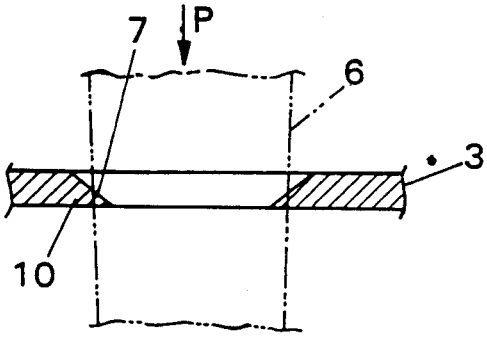
FIG. 3 is an enlarged cross sectional view showing the shape of a hole formed in the plate electrode of FIG. 1.

As shown in FIG. 2, spacers 8 are disposed between the adjacent plate electrodes 3 to provide a specified spacing therebetween. The reference numeral 9 indicates a space formed in the plate electrodes 3 to allow passage of the electron beams.

Figure 4:
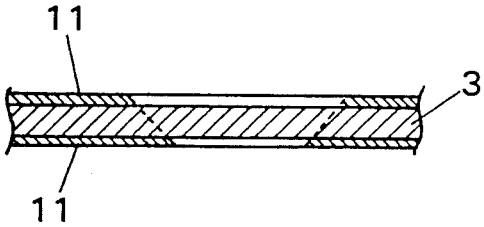
FIG. 4 is an enlarged cross sectional view showing how the hole is formed according to the present invention.

The holes 7, into which the insulating pin 6 is press-fitted, are provided along a common axis through the plate electrodes 3. Out of the three plate electrodes 3, the hole 7 of the plate electrode 3 which comes first in the press-fitting direction P of the insulating pin 6 is taken as an example for description with reference to FIGS. 3 and 4. The hole 7 is formed in an inverted truncated cone shape, having a diameter of 1.0 mm at the front side facing the press-fitting direction P (at the upper side in FIG. 1) and a diameter of 0.88 to 0.94 mm at the reverse side (on the lower side in FIG. 1), and the peripheral portion 10 of the hole 7 is formed in a thin construction, having a triangularly shaped cross section. The hole 7 of the above shape is preferably formed, as shown in FIG. 4, by coating a resist 11 on the upper and lower surfaces of the plate electrode 3 and removing the unwanted portion by means of a etching technique, but other known processes can be used for forming the hole 7. The holes 7 formed in the second and lower positioned plate electrodes 3 are provided with smaller diameters to match the tapered shape of the insulating pin 6, but the peripheral portion 10 of each hole is formed in the same shape and size.

On the other hand, the insulating pin 6 has a diameter of 0.8 mm at its base. This diameter is set to a dimension equal to or smaller than two-thirds of the width of the hole 7 provided in the plate electrode 3. It has been confirmed in an experiment conducted by the inventors of the present invention that setting the diameter of the insulating pin 6 to the above dimension helps to prevent the electric field in the space 9 through which the electron beams pass from being disturbed in the vicinity of the insulating pin 6 by the effect of the insulating pin 6. This prevents misalignment of the landing areas of the electron beams due to the turbulence of the electric field, and a picture of uniform quality can be obtained.

As shown in FIG. 2, the insulating pin 6 is pressed by a press-fitting pin 12 and inserted into the holes 7 formed in the plate electrodes 3. The insulating pin 6 when inserted causes each hole 7 to deform in the press-fitting direction P at its peripheral portion 10 where the construction is thin. Since only the peripheral portion 10 is subjected to deformation, the areas surrounding the peripheral portion 10 are prevented from deforming.

After the plate electrodes 3 are thus supported and fixed in position, the spacers 8 are removed as shown in FIG. 1, and dust and other foreign matter remaining on the surfaces of the insulating pin 6 and plate electrodes 3 are removed by air blow or other means, after which the plate electrodes 3 are subjected to a dielectric strength test, and then assembled into a flat display unit.

Example 2

Figure 5:
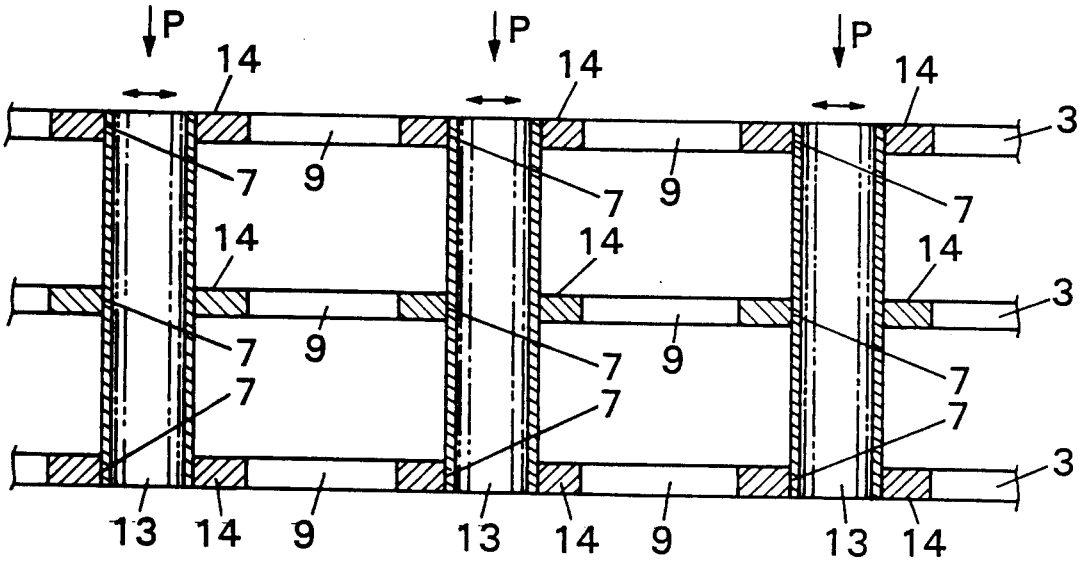
FIG. 5 is a cross sectional view showing a portion of a fixed construction for plate electrodes according to a second embodiment of the present invention.
Figure 6:
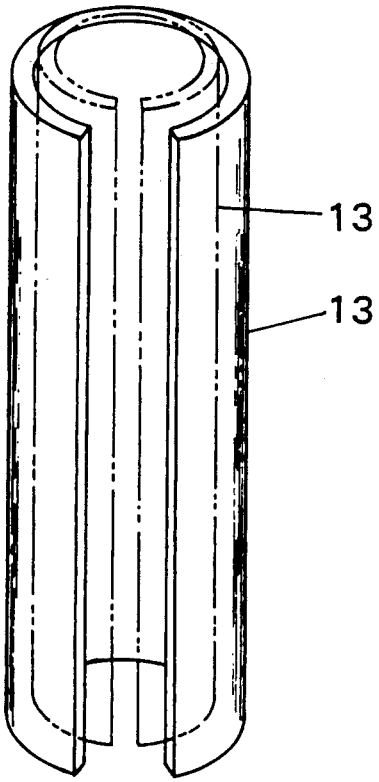
FIG. 6 is a perspective view showing the entire construction of an insulating pin of FIG. 5.

FIGS. 5 and 6 illustrate a second embodiment of the present invention. Since the general construction of the flat display unit described in this embodiment is the same as that described in the first embodiment, like reference numerals are used to indicate like parts, and description of them is omitted.

In this embodiment, a shape memory alloy plate having a C-shaped cross section and coated with an insulating material over its outer circumferential surface is used to form an insulating pin 13 which is shown in FIG. 6. On the other hand, the holes 7 of the plate electrodes 3 through which the insulating pin 13 is inserted are cylindrically shaped, and have the same diameter between the plate electrodes 3. The insulating pin 13 is so constructed that its outer diameter will become slightly larger than that of each hole 7 of the plate electrodes 3 at a prescribed temperature, the diameter at room temperature being smaller than that of the hole 7 as shown by an imaginary line in FIG. 6. The prescribed temperature should be set preferably within the range of 200° to 300° C. that does not cause thermal deformation to the plate electrodes 3.

According to this embodiment, the plate electrodes 3 are supported using spacers or the like to provide a specified spacing therebetween, and then the insulating pin 13 is inserted (in direction P) into the holes 7. At this time, since the outer diameter of the insulating pin 13 is smaller than that of each hole 7, no sliding friction is caused between the insulating pin 13 and the peripheral portion 14 of each hole 7, and there is no possibility of the peripheral portion 14 deforming in the inserting direction P or being rubbed to release metal powder.

After inserted, the insulating pin 13 is heated to the prescribed temperature so as to expand in diameter, causing the outer circumferential surface thereof to press against the peripheral portion 14 of each hole 7. Thus, the plate electrodes 3 become fixed in position, being supported with the specified spacing provided therebetween. After that, the thus fixed plate electrodes 3 are cleaned of dust and other foreign matter by means of immersion or steam cleaning, subjected to dielectric strength test, and then assembled into a flat display unit.

The present invention is not limited to the construction of the above embodiment, but may be constructed in other ways.

For example, the shape and material of the insulating pin, the shape of the hole of the plate electrode, and the supporting method for the plate electrodes are not limited to the examples described in the above embodiment, but may be designed to suit specific applications as necessary.

Example 3

A third embodiment of the present invention is described below with reference to FIGS. 7 to 9.

Figure 8:
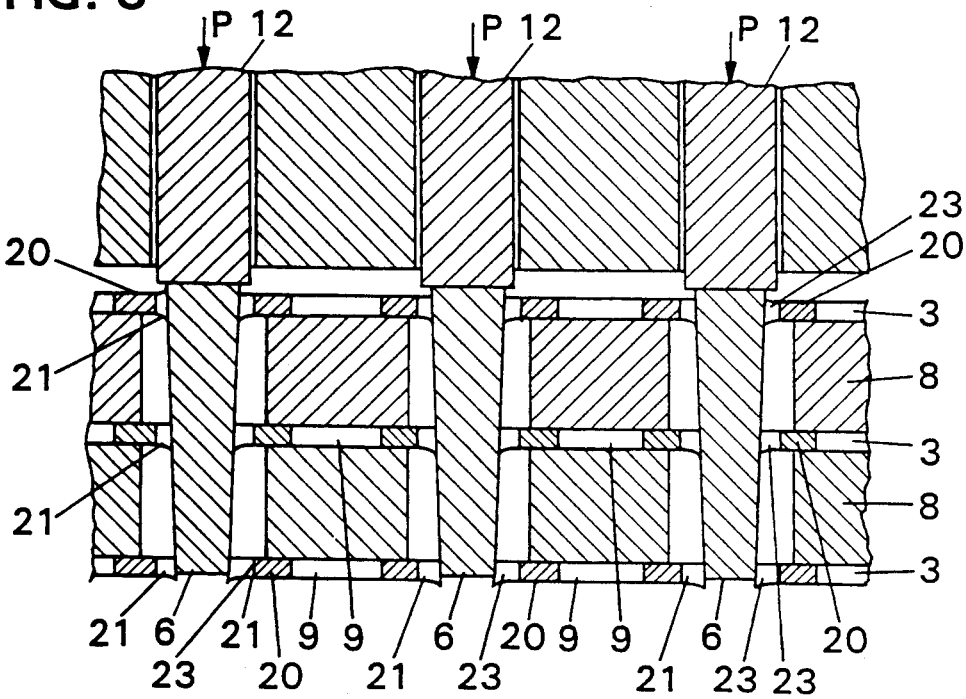
FIG. 8 is a cross sectional view showing a portion of the construction with insulating pins inserted into holes of the plate electrodes of FIG. 7.
Figure 9:
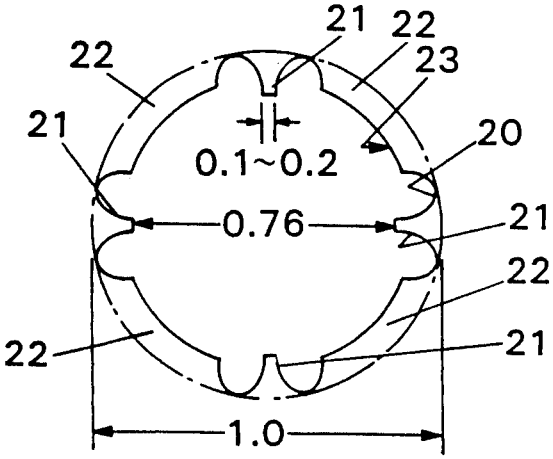
FIG. 9 is a plan view showing the shape of a hole formed in the plate electrode of FIG. 7.

As shown in FIG. 8, spacers 8 are interposed between the plate electrodes 3 to provide a specified spacing therebetween. The reference numeral 9 indicates a space provided in the plate electrodes to allow passage of the electron beams.

The plate electrodes 3 are provided with holes 23 which are formed on a common axis and into which the insulating pin 6 is press fitted. Out of the three plate electrodes 3, the hole 23 of the plate electrode 3 which comes first in the press-fitting direction P of the insulating pin 6 is taken as an example for description with reference to FIGS. 9. The hole 23 has a diameter of 1.0 mm, and is provided at four places with projections 21 protruding inwardly of the peripheral portion 20 thereof. The width of the tip portion of each projection 21 is approximately 0.1 to 0.2 mm, and the distance between the tips of the facing projections 21 and 21 is 0.76 mm. Also, a reinforcement 22 is formed, projecting inwardly, between the adjacent projections 21 and 21 to reinforce the strength of the peripheral portion 20. The holes 23 formed in the second and lower positioned plate electrodes 3 have smaller diameters to match the tapered shape of the insulating pin 6, but the projecting amount of the projections 21 is the same among the holes 23.

On the other hand, the insulating pin 6 has a diameter of 0.8 mm at its base. This diameter is set to a dimension equal to or smaller than two-thirds of the width of the hole 7 provided in the plate electrode 3. It has been confirmed in an experiment conducted by the applicant of the present invention that setting the diameter of the insulating pin 6 to the above dimension helps to prevent the electric field in the space 9 through which the electron beams pass from being disturbed in the vicinity of the insulating pin 6 by the effect of the insulating pin 6. This prevents misalignment of landing positions of the electron beams due to the turbulence of the electric field, and the picture of uniform quality can be obtained.

As shown in FIG. 8, the insulating pin 6 is pressed by a press-fitting pin 12, and inserted into the holes 23 of the plate electrodes 3. The insulating pin 6, when being inserted, slidingly contacts the tips of the projections 21 provided in each hole 23 and causes them to deform in the inserting direction P. As this time, since the insulating pin 6 does not contact the peripheral portion 20 of each hole 23 with only the projections 21 subjected to deformation, the peripheral portion 20 is prevented from deforming.

Figure 7:
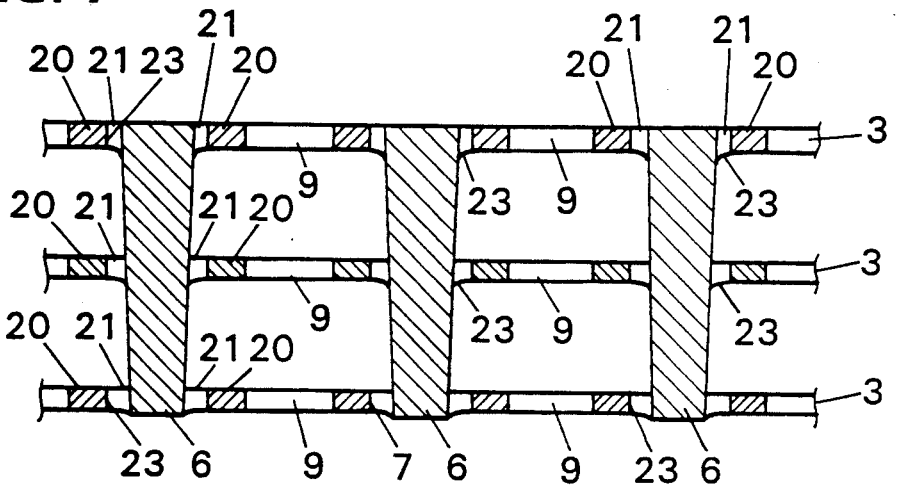
FIG. 7 is a cross sectional view showing a portion of a fixed construction for plate electrodes according to a third embodiment of the present invention.

After the plate electrodes 3 are thus supported and fixed in position, the spacers 8 are removed as shown in FIG. 7, and dust and other foreign matter remaining on the surfaces of the insulating pin 6 and plate electrodes 3 are removed by air blow or other means, after which the plate electrodes 3 are subjected to a dielectric strength test, and then assembled into a flat display unit.

Example 4

Figure 10:
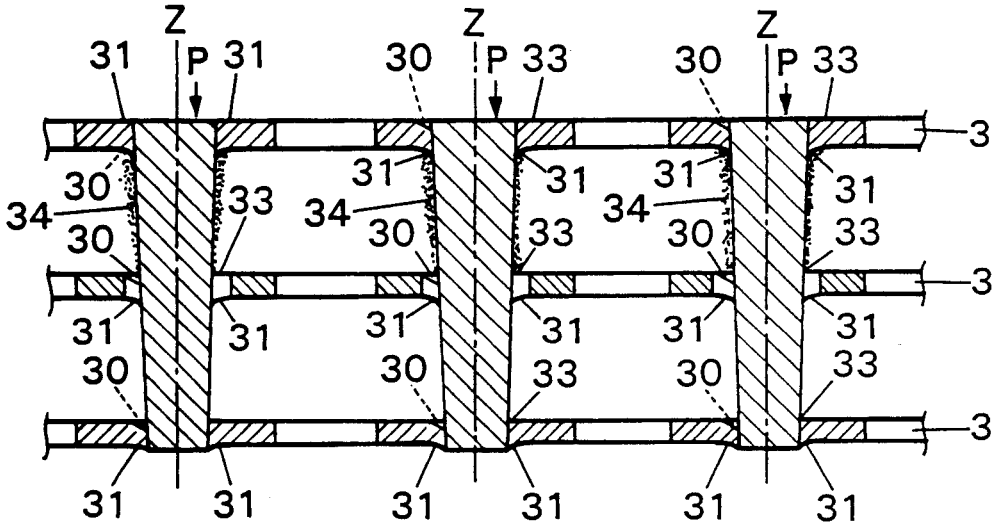
FIG. 10 is a cross sectional view showing a portion of a fixed construction for plate electrodes according to a fourth embodiment of the present invention.
Figure 11:
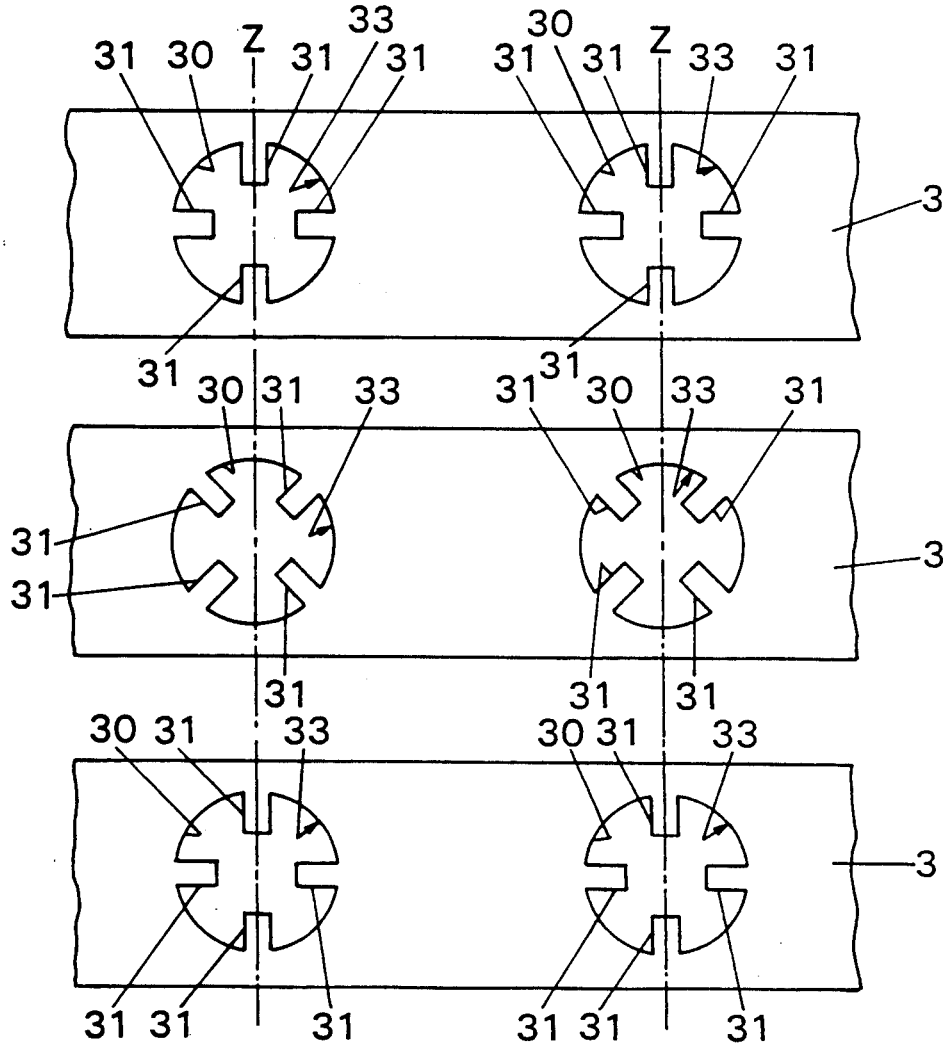
FIG. 11 is a plan view of the plate electrodes of FIG. 10 arranged for clarity from top to bottom in the order in which the insulating pin is inserted.

FIGS. 10 and 11 illustrate a fourth embodiment of the present invention. Since the general construction of the flat display unit described in this embodiment is the same as that described in the third embodiment, like reference numerals are used to designate like parts, and any description thereof is omitted.

In this embodiment, as shown in FIG. 11, the projections 31 protruding inwardly of the peripheral portion 30 of each hole 33 are positioned 45 degrees offset in the circumferential direction with respect to the projections 31 provided on the hole 33 formed along a common axis z through the adjacent plate electrode 3, so that the projections 31 will not align with each other in the axial direction.

According to this embodiment, the insulating pin 6 contacts the projections 31 when inserted through the hole 33 of the first plate electrode 3, causing them to deform in the inserting direction P. At this time, metal powder 34 shaved off the tips of the projections 31 by the insulating pin 6 adheres in streaks to the surface of the insulating pin 6 where it contacts the projections 31.

The insulating pin 6, when inserted through the hole 33 of the second plate electrode 3, contacts the projections 31 of the hole 33 and causes them to deform in the inserting direction P, while the metal powder 34 comes close to the projections 31. However, since the projections 31 are offset 45 degrees in the circumferential direction from each other between the first and second plate electrodes 3, the metal powder 34 is prevented from coming into contact with the projections 31 of the hole 33 of the second plate electrode 3, thus preventing the dielectric strength provided between the plate electrodes 3 from dropping. In this embodiment, the tapered shape of the insulating pin 6 and the projecting amount of the projections 31 are so determined that the portions of the surface of the insulating pin 6 which contact the projections 31 when inserted through the hole 33 of the first plate electrode 3 will not come in contact with the projections 31 when inserted through the third plate electrode 3.

Next, the spacers 8 are removed as shown in FIG. 10, after which the plate electrodes 3 are cleaned of dust and other foreign matter by means of immersion or steam cleaning, subjected to a dielectric strength test, and then assembled into a flat display unit.

The present invention is not limited to the construction of the above embodiment, but may be constructed in other ways.

For example, the shape and material of the insulating pin, the shape of the hole of the plate electrode, and the supporting method for the plate electrodes are not limited to the examples described in the above embodiment, but may be designed to suit specific applications as necessary.

As described above, according to the present invention, since only the peripheral portions of the holes of the plate electrodes are subjected to deformation when the tapered insulating pin is press-fitted, the deformation is prevented from expanding to the areas surrounding the holes, and the plate electrodes can be supported and fixed accurately in position with a specified spacing provided therebetween, thereby preventing degradation of the picture quality due to misalignment of the landing areas of the electron beams.

Also, according to the present invention, since the insulating pin formed from shape memory alloy expands in diameter to press-contact the peripheral portions of the holes of the plate electrodes to support and fix the plate electrodes in position, no sliding friction is caused between the insulating pin and the peripheral portions of the holes, which offers the advantage, in addition to the above-mentioned one, that there is no possibility of shorting being caused between the plate electrodes due to metal powder shaved off the peripheral portions and made to adhere to the surface of the insulating pin, and also no possibility of the surface of the insulating pin being flawed to cause a drop in the dielectric strength of the plate electrodes.

Furthermore, according to the present invention, since the construction can be made so that the insulating pin does not come in contact with the peripheral portions of the hole of the plate electrodes, the peripheral portions are prevented from deforming, which, as a result, assures the dimensional accuracy of the spacing provided between the plate electrodes, thereby preventing degradation of the picture quality due to misalignment of the landing areas of the electron beams.

Moreover, according to the present invention, since the metal powder shaved by the projections of the holes and made to adhere to the surface of the insulating pin when inserted through one plate electrode is prevented from contacting the projections of the hole of the adjacent plate electrode, there is no possibility of the dielectric strength dropping between the plate electrodes due to the metal powder adhering to the surface of the insulating pin.

Also, according to the present invention, since the plate electrodes can be supported and fixed in position without interposing spacers, there is no possibility of oxidation or thermal deformation of the plate electrodes due to heating which has been the case with the prior art, and as a result, accurate landing areas on the screen of the electron beams is assured, thus improving the resulting picture quality.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A fixed construction for plate electrodes in a flat display unit, wherein holes provided along a common axis through a plurality of plate electrodes have a diameter smaller than that of a tapered insulating pin to be inserted therein, and the peripheral portions of the holes are formed in a thin or tapered construction.

2. A fixed construction for plate electrodes in a flat display unit, wherein a plurality of plate electrodes are supported and fixed in position by inserting into holes formed along a common axis therethrough an insulating pin which is formed by a shape memory alloy having a C-shaped cross section whose outer diameter is slightly smaller before insertion than that of the holes but slightly expands at a prescribed temperature after insertion and whose outer circumferential surface is covered with an insulating material, said insulating pin being made to slightly expand in diameter at the prescribed temperature after insertion so as to support and fix said plate electrodes in position.

3. A fixed construction for plate electrodes in a flat display unit, wherein holes formed along a common axis through a plurality of plate electrodes are provided with a plurality of projections protruding inwardly of the peripheral portions thereof, said plate electrodes being supported and fixed in position by inserting a tapered insulating pin into the holes with the projections thereof pressing the outer circumferential surface of the insulating pin.

4. A fixed construction for plate electrodes in a flat display unit according to claim 3, wherein said projections provided on the holes formed along the common axis are offset from each other in the circumferential direction of the holes between the adjacent plate electrodes.

* * * * *